US005463954A

United States Patent [19]

Blair

[11] Patent Number: 5,463,954

[45] Date of Patent: Nov. 7, 1995

[54] CONDUCTIVE POLYMER IGNITORS

[75] Inventor: David W. Blair, Princeton, N.J.

[73] Assignee: Princeton Scientific Enterprises, Inc., Princton, N.J.

[21] Appl. No.: 213,616

[22] Filed: Mar. 15, 1994

[51] Int. Cl.[6] ..... F42C 19/12

[52] U.S. Cl. ..... 102/202; 102/202.5; 60/256

[58] Field of Search ..... 60/39, 823, 256; 102/202, 202.5, 202.7, 202.8, 472

[56] References Cited

U.S. PATENT DOCUMENTS

| | | | |
|---|---|---|---|
| 1,568,069 | 1/1926 | Jenkins | 102/202.5 |
| 2,998,704 | 9/1961 | Biazil et al. | 102/202 |
| 3,434,426 | 3/1969 | De Dapper | 102/202.8 |
| 3,713,385 | 1/1973 | Lovecy . | |
| 3,765,334 | 10/1973 | Rentz et al. . | |
| 3,815,507 | 6/1974 | Irish, Jr. et al. | 102/202.8 |
| 4,206,705 | 6/1980 | Iqbal et al. . | |
| 4,831,933 | 5/1989 | Nerheim et al. | 102/202.5 |
| 4,862,803 | 9/1989 | Nerheim et al. | 102/202.5 |
| 5,029,529 | 7/1991 | Mandigo et al. | 102/202.7 |
| 5,378,403 | 1/1995 | Shacklette | 252/500 |

FOREIGN PATENT DOCUMENTS

| | | | |
|---|---|---|---|
| 1140604 | 1/1969 | United Kingdom | 102/472 |

*Primary Examiner*—Harold J. Tudor

*Attorney, Agent, or Firm*—Mathews, Woodbridge & Collins

[57] ABSTRACT

A system and method is provided for igniting a propellant with an electrically conductive chemically insensitive polymer. The polymer is an electrical resistance heater to heat the propellant to its ignition temperature. Preferably, the polymer is an organic polymer. Surfaces of the propellant can be coated with the polymer. In the alternative, the polymer can be applied to a hollow bore in the propellant to form a self-pressurizing charge. Advantageously, the present invention controls ignition and prevents unintended ignition of the propellant.

12 Claims, 2 Drawing Sheets

CONDUCTIVE POLYMER IGNITORS

BACKGROUND OF THE INVENTION

1. Field of the Invention

This invention relates to a system that uses chemically insensitive, stable, electrically conductive organic polymers for igniting propellant charges either directly or through secondary materials.

2. Description of Related Art

The ignition of propellant charges, particularly large charges such as those employed in artillery rounds, imposes several stringent requirements on the ignitor. For best ballistic performance, ignition is achieved in a prescribed manner that attempts to control the rate of spreading of a flame front over a propellant and the magnitude of any pressure pulse that is introduced by the ignitor. The sensitivity of the ignitor to inadvertent ignition is also a design consideration.

Conventional ignitors typically use an unstable chemical compound which is activated by a shock for producing ignition, i.e. a detonator. Typically, a mechanical shock is introduced by a firing pin. The detonation of the ignitor ignites either the primary propellant charge or a secondary ignition charge. If a secondary ignition charge is not used, the primary propellant charge is ignited at points that are exposed to the hot detonation products. When a secondary propellant charge is used, it is ignited by the hot products from the detonator and a flame spreads through it. The hot combustion products from this flame ignite the primary propellant charge. Secondary ignitor charges are often used to enhance the rate of flame spreading and to pressurize primary charges which may burn either very slowly or not at all at atmospheric pressure. The time sequence of ignition of the surfaces of the primary propellant is controlled by spreading of flames from the initial ignition points on that charge that were established from the ignitor. This process of ignition and flamespreading has the shortcoming that it is quite imprecise.

It is also necessary to avoid unintended ignitions of munition rounds. Conventional solutions for avoiding unintended ignitions have included using "insensitive" primary propellants to reduce the chances of inadvertent ignition of the charge through heat or shock by external influences other than the intended ignition event, i.e., other than by an intended firing. However, conventional ignitors are heat and shock sensitive and when they are used they greatly reduce the safety advantages that are otherwise inherent in the use of "insensitive" primary propellant charges.

Another approach for reducing the problem of unintended ignition has been to replace the detonator with a laser to ignite the primary propellant or a secondary ignitor charge. While effective in enhancing the safety of munitions, laser systems are complex, expensive and require flame spreading to ignite the entire surface of the primary charge. Laser systems generally require the use of a secondary propellant charge to provide sufficient hot gas to ignite the primary propellant charge in a timely fashion and to provide initial pressurization of the propellant charge.

U.S. Pat. No. 4,206,705 describes an electric initiator containing an explosive sensitive material, such as polymeric sulfur nitride. That material is electrically conductive as well as chemically sensitive. Electrical current is applied to the material which causes it to detonate and thus ignite a propellant charge adjacent to it. The teachings of this patent have the shortcoming that the initiator is a highly chemically sensitive material which can lead to unintended ignition.

U.S. Pat. No. 3,713,385 describes an electroexplosive device consisting of a mixture of an explosive substance with an electrically conductive material in fibrous form. A sufficient quantity of the electrically conductive material is properly distributed throughout a primary propellant charge to provide an electrically conductive path through the mixture. Electrical current is passed through the mixture to ignite it. The electrically conductive material constitutes between 5 and 35 percent by weight of the mixture. The technology described in this patent has the drawback that the use of such a large quantity of an electrically conductive material which is a non-energetic substance degrades the ballistic performance of the round. Additionally, the mixture can settle out resulting in significant variation in results in round to round ballistic performance.

SUMMARY OF THE INVENTION

Briefly described, the present invention relates to a system and method for using an electrically conductive and chemically insensitive organic polymer as an electrical resistance heater to ignite a propellant. The polymer provides the electrical resistance heater for ignition and is shock and heat insensitive. Other energetic materials can also be thermally ignited with the present invention.

The polymer can be used in a munition to provide precise control of ignition timing sequences by depositing thermal energy over the surface of the propellant charge at a rate controlled by electrical propagation, which is exceedingly rapid. By varying the cross sectional area of the electrical path of the conductive polymer, the rate of conversion of electrical energy to thermal energy and its application to the propellant can be controlled over the ignition surface of the propellant. This provides precise control of ignition timing over the surface of the propellant charge, and it permits the attainment of optimum ballistic performance for the round.

In a first embodiment, the polymer is deposited on a predetermined path on either internal or external surfaces of the propellant. The ends of the path are connected to an electrical source. Upon application of an electrical voltage to the polymer, current flows through it. Electrical heating raises the temperature of the polymer to the ignition temperature of the propellant. In a second embodiment sufficient voltage is applied to the polymer to cause the polymer to establish an electrical arc discharge to ignite the propellant. In the above embodiments, the polymer is deposited in intimate contact with the propellant charge to ignite it directly. The polymers have the advantage of being chemically insensitive and thus immune to unintended ignitions.

In alternative embodiments, the polymers of the present invention can be used with ignitors which use a secondary ignition charge. The ignited secondary charge, in turn, ignites the primary propellant charge. In this alternate embodiment, the polymers have the advantage of providing precise control of the ignition timing of the secondary charge. In other embodiments, the polymers can be applied both to single grain primary charges and to multi-grain charges. The polymers can also be applied internally in large single grains to form self-pressurizing ignition systems. Additionally, the polymers can be used to establish an electrical arc in a chemically inert material and impart propulsive energy to that material by electrical arc heating.

The invention may be more fully understood by reference to the following drawings.

DETAILED DESCRIPTION OF THE INVENTION

During the course of this description like numbers will be used to identify like elements according to the different views which illustrate the invention.

Figure 1:
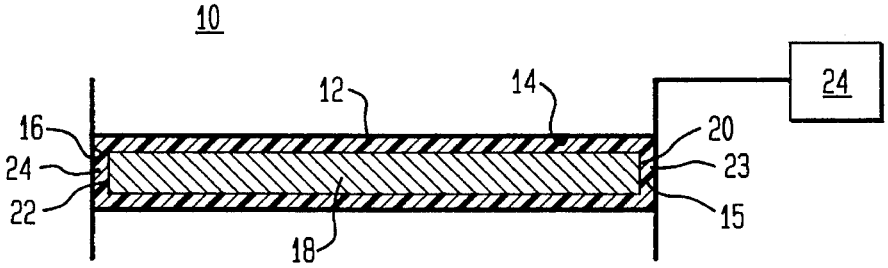
FIG. 1 is a schematic axial section diagram of the ignitor system of the present invention including an electrically conductive polymer of the present invention applied to lateral and end surfaces of a propellant grain.

FIG. 1 is a schematic axial section diagram of ignitor system 10 in accordance with the teachings of the present invention. Insensitive conductive polymer 12 is applied to side surface 14 and end surfaces 15, 16 of propellant charge 18. Insensitive conductive polymer 12 can be applied by coating insensitive conductive polymer 12 on side surface 14 and end surfaces 15, 16. Electrodes 20 and 22 contact respective end surfaces 23 and 24 of the conductive polymer 12.

Power source 24 applies electric voltage between electrode 20 and electrode 22. When electric voltage is applied between electrode 20 and electrode 22, current flows from electrode 20 through insensitive conductive polymer 12 to electrode 22, heating the insensitive conductive polymer 12 by electrical resistance heating and the propellant charge 18 by heat transfer from insensitive conductive polymer 12. The passage of electric current heats insensitive conductive polymer 12. Heat is transferred from insensitive conductive polymer 12 to propellant charge 18 thereby raising the temperature of propellant charge 18 to its ignition temperature. In an alternative embodiment, sufficient electric voltage is applied to break down insensitive conductive polymer 12 to form an electric arc between-electrodes 20 and 22. The electric arc ignites propellant charge 18.

Preferably, insensitive conductive polymer 12 is an organic polymer comprising a non-energetic material which is electrically conductive. Most preferably, insensitive conductive polymer 12 is formed of polyaniline. A polyaniline composition useful for practice of this invention is manufactured by Allied Signal Corporation, Morristown, N.J. as Versicon®. Versicon® is a registered trademark of Allied Signal Corporation. Versicon® has a conductivity of 1–10 seiman/cm. Other forms of polyaniline can also be used in the present invention, such as leucopolyaniline and pernigraniline. A commercial solution of the polymer can be obtained as a concentrate manufactured by Americhem, Inc. as Americhem Green Concentrate No. 35315-W1. The conductivity of Americhem Green is about 5 seiman/cm. The solution of the polymer can be coated on the intended surface and dried at room temperature. Preferably, during combustion of propellant charge 18, insensitive conductive polymer 12 is consumed leaving a minimum residue. The use of an organic polymer produces a non-corrosive residue.

The insensitive conductive polymer 12 can be applied with varied thicknesses to side surface 14 and end surfaces 15, 16 for providing control of the ignition timing over the surface of propellant charge 18. Increased heat is generated over the areas of propellant charge 18 that have a thinner coating of insensitive conductive polymer 12. Preferably, insensitive conductive polymer 12 can be applied at a thickness in the range of about 0.1 mm to about 0.3 mm. The thickness of insensitive conductive polymer 12 applied to side surface 14 and end surfaces 15, 16 can be selectively varied to control the rate of conversion of electrical energy into thermal energy, thereby controlling the timing of ignition of propellant charge 18.

Figure 2A:
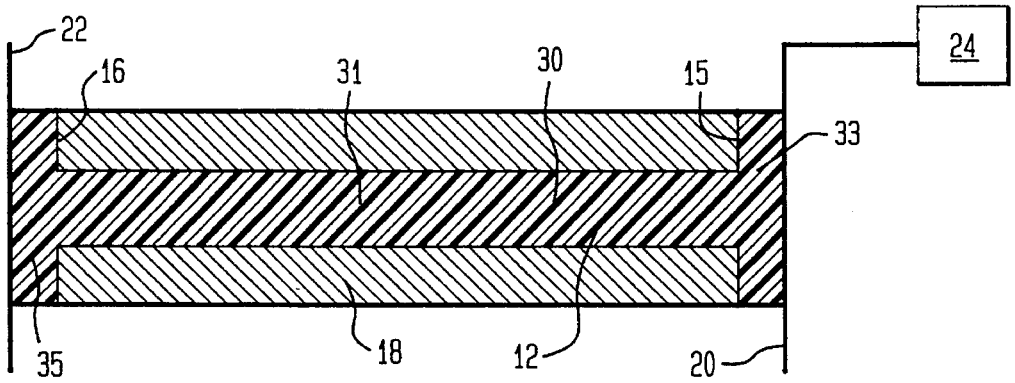
FIG. 2A is a schematic axial section diagram of the ignitor system of the present invention including the electrically conductive polymer of the present invention applied to an axial hole within the propellant and ends of the propellant.
Figure 2B:
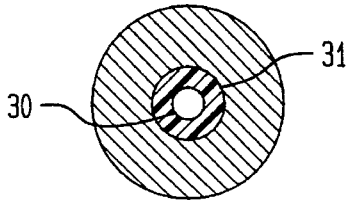
FIG. 2B is a modified cross-sectional view of the ignitor system shown in FIG. 2A showing an axial hole through the conductive polymer layer.

FIGS. 2A–2B show alternate embodiments in which a portion 31 of insensitive conductive polymer 12 is applied to hollow cavity 30 within propellant charge 18. Portions 33, 35 of insensitive conductive polymer 12 are applied to respective end surfaces 15, 16 of propellant charge 18. Portion 31 of insensitive conductive polymer 12 is coupled to portions 33, 35 of insensitive conductive polymer 12. Portion 31 of insensitive conductive polymer 12 can be applied by coating or pressing a strand of insensitive conductive polymer 12 into hollow cavity 30. Upon application of electrical voltage between electrode 20 and electrode 22, current flows from portion 33 through portion 31 and to portion 35 of insensitive conductive polymer 12 to produce heat in portions 31, 33 and 35 for igniting propellant charge 18.

Preferably, the insensitive conductive polymer 12 fills hollow cavity 30 or has a small free space between conductive polymer 12 and hollow cavity 30. Upon ignition, efflux of gases within hollow cavity 30 increases the pressure within hollow cavity 30 thereby accelerating the combustion process of propellant charge 18, which process can be defined as a self-pressurizing ignition system. It is advantageous to use a self-pressurizing ignition system for propellants which do not normally burn at atmospheric pressure.

Figure 3A:
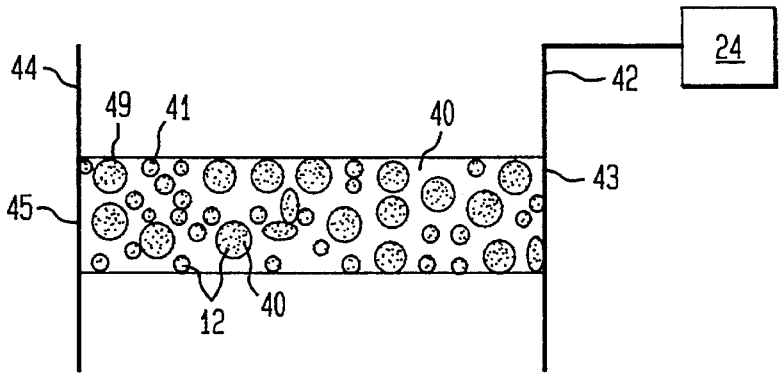
FIGS. 3A and 3B is a schematic axial section diagram of the ignitor system of the present invention including the electrically conductive polymer of the present invention applied to individual grains of propellant and between grains of propellant.

Another alternate embodiment of the present invention is shown in FIG. 3A. Grains 41 of a propellant charge 40 are coated with insensitive conductive polymer 12. Preferably, a large number of grains 41 are coated with insensitive conductive polymer 12. The number of grains can be in the range of about 10 to over 1,000,000 grains depending upon the size of the total charge. In one embodiment, coated grains 41 are held loosely within casing 49. Electric current supplied from power source 24 is pulsed through electrodes 42 and 44 positioned at respective ends 43 and 45 of casing 49. Current is pulsed from electrode 42 and passes over grains 41 to electrode 44. Grains 41 are heated and ignited as a collection of individual grains, thereby having the burning characteristics of a multigranular charge.

Figure 3B:
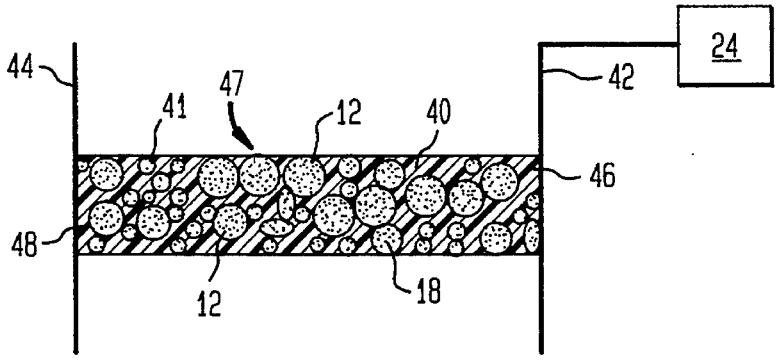

In another alternate embodiment, grains 41 are coated with insensitive conductive polymer 12 are then together compressed into a single grain 47 which is a caseless charge, as shown in FIG. 3B. Space between grains 41 is filled with insensitive conductive polymer 12. Electrodes 42 and 44 are positioned at respective ends of 46 and 48 of single grain 47.

Current flows from electrode 42 through single grain 47 to electrode 44 for heating single grain 47.

Figure 4:
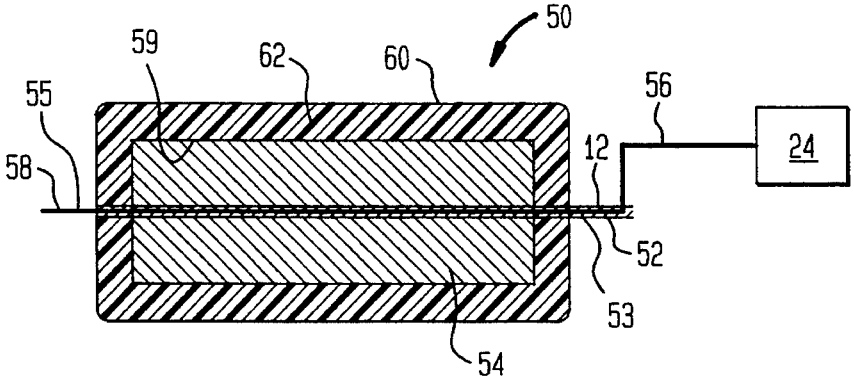
FIG. 4 is a schematic axial section diagram of the ignitor system of the present invention including the electrically conductive polymer of the present invention applied to a two stage ignitor.

FIG. 4 is a schematic diagram of a two stage ignitor 50. Secondary ignitor charge 54 is positioned adjacent or is surrounded by primary propellant charge 62. Insensitive conductive polymer 12 is coated on or impregnated into a thread 52. Thread 52 extends in the longitudinal direction through secondary ignitor charge 54. Preferably, secondary ignitor charge 54 is formed of black powder. Ends 53 and 55 of thread 52 are connected to respective electrodes 56 and 58. Casing 59 surrounds secondary ignitor charge 54. Casing 59 is placed within container 60 which contains primary charge 62. Upon application of electric voltage from power source 24, current flows from electrode 56 to electrode 58 through insensitive conductive polymer 12 for igniting secondary charge 54. The ignition of secondary charge 54 ignites primary propellant charge 62.

Propellant charges 18, 40, 47, 54 and 62 can be formed of M30, RDX, LOVA and black powder. It will be appreciated that other materials can be used to form propellant charges.

Figure 5:
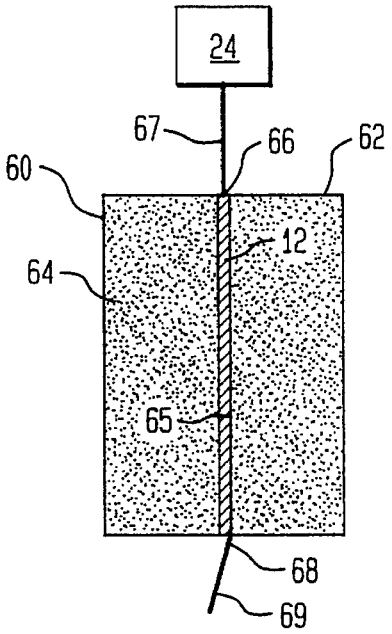
FIG. 5 is a schematic axial section diagram for a system for activating a chemically inert material.

FIG. 5 is a schematic diagram for a system for activating a chemically inert material 64. Container 62 contains a chemically inert material 64. An example of a chemically inert material 64 is Helium. It will be appreciated that other chemically inert materials can be used in accordance with the teachings of the present invention.

Insensitive conductive polymer 12 is coated on or impregnated onto a thread 65. Thread 65 extends through container 62. End 66 of thread 65 is connected to electrode 67 and end 68 of thread 65 is connected to electrode 69. Sufficient electric voltage is applied by power source 24 to electrode 67 to break down insensitive conductive polymer 12 to form an electric arc between electrodes 67 and 69. The electric arc initiated by the breakdown of insensitive conductive polymer 12 provides propulsive energy to the chemically inert material 64 by electrical arc heating.

The following examples serve to further typify the nature of this invention but should not be construed as a limitation on the scope thereof, which scope is defined solely by the appended claims.

EXAMPLE 1

M30 propellant was pressurized to 130 psig in nitrogen. All samples of the propellant were 6.4 mm in diameter. The outer surface of the propellant was coated with insensitive conductive polymer 12, as shown in FIG. 1. A 20 microfarad capacitor bank produced electric pulses. Results for samples A–D are shown in Table 1.

TABLE 1

Pulsed Ignition of M30 Propellant Pre pressurized to 130 psig in Nitrogen Capacitance 20 Micro farads.

| Sample | Volts | Joules | Ohms | Ignition |
|---|---|---|---|---|
| A | 1000 | 10 | 4.40 E + 05 | Yes |
| B* | 500 | 2.5 | 8.80 E + 04 | Yes |
| C* | 1000 | 10 | 6.00 E + 04 | Yes |
| D** | 500 | 2.5 | 3560 | Yes |

*Coated with polyaniline only.
**Coated with epoxy, then polyaniline.

The results show that the application of 1000 volts into a resistance of 444,000 ohms resulted in ignition. The application of a small pulse of 500 volts into a resistance of 3560 ohms also resulted in ignition.

EXAMPLE 2

RDX was pressurized to 130 psig in nitrogen. Samples-A–C had a diameter of 9.1 min. The outer surface of the propellant was coated with insensitive conductive polymer 12, as shown in FIG. 1. Results for samples A–C are shown in Table 2.

TABLE 2

Pulsed Ignition of RDX Propellant Pre pressurized to 130 psi in Nitrogen. Capacitance 20 Micro farads.

| Sample | Volts | Joules | Ohms | Ignition |
|---|---|---|---|---|
| A | 2000 | 40 | 1.27 E + 08 | Yes |
| B | 2000 | 40 | 9.90 E + 07 | Yes |
| C | 1000 | 10 | 1.75 E + 06 | Yes |

The results demonstrate ignition for samples A–C.

EXAMPLE 3

RDX was pressurized to 200 psi in nitrogen. All samples of the propellant were 9.1 mm in diameter with a 0.101 inch axial hole. An insensitive conductive polymer 12 was applied, as shown in FIG. 2. The results are shown in table 3.

TABLE 3

Pulsed Ignition of a Sample of RDX Coated on Ends and in 0.101 inch Axial Hole Pre pressurized to 200 psi in Nitrogen, Capacitance 20 Micro farads

| Sample | Volts | Joules | Ohms | Ignition |
|---|---|---|---|---|
| A | 500 | 20 | 4.1 E + 07 | No |
| B | 1000 | 20 | 8.4 E + 07 | Yes |

An electric pulse of 1000 volts ignited Sample B.

EXAMPLE 4

9.1 mm diameter samples of a low sensitivity propellant LOVA were pressurized to 200 psi in nitrogen. Samples A, B, H and I included a 0.101 inch axial hole. The outer surface and inner surface of the axial hole were coated with conductive polymer 12, as shown in FIG. 2. The outer surface of the propellant for samples-C–G was coated with insensitive conductive polymer 12, as shown in FIG. 1. Samples A–G were directly connected to a direct current power supply. Samples H and I were directly connected to a variable transformer that operated from 120 v alternating current. The results are shown in Table 4.

TABLE 4

Tests of LOVA Propellant at 200 psi in Nitrogen

| Sample # | Volts | Ohms | Ignition |
|---|---|---|---|
| A | 500 | 290 | Yes |
| B | 100 | 722 | No |
| C | 1000 | 6.70 E + 07 | Yes |
| D | 1000 | 2.09 E + 08 | Yes |
| E | 250 | 272 | Yes |
| F | 500 | 4.40 E + 06 | Yes |
| G | 750 | 2.10 E + 07 | Yes |
| H | 145 | 596 | Yes |
| I | 145 | 310 | Yes |

The results show that quite low voltages of 250 volts can achieve ignition and that under long low voltage pulses the polymer achieves ignition temperatures rather than melting and acting as a fusible link.

The present invention has the advantage of providing controlled ignition of munitions. An insensitive conductive polymer thermally heats a propellant to an ignition temperature. The insensitive conductive polymer prevents unintended ignition of the propellant. Advantageously, the polymers can be applied to the inside surface of a hollow propellant for forming self-pressurizing ignition systems to ignite propellants which do not normally burn at atmospheric pressure. In addition, the polymer can be applied with various thickness to the propellant for the advantage of controlling timing of ignition. The polymer can also be applied to a plurality of grains for forming a multigrain charge. The ignition system can be used directly or in combination with a secondary ignition charge to ignite primary propellant charges.

While the invention has been described with reference to the preferred embodiment thereof, it will be appreciated by those of ordinary skill in the art that modifications can be made to the structure and form of the invention without departing from the spirit and scope thereof.

I claim:

1. An propellant system comprising:

a primary propellent;

a chemically insensitive conductive polymer coated on a surface of said primary propellent; and means to supply current to said polymer, wherein said current heats said polymer to a temperature sufficient to ignite said primary propellant in contact with said polymer, the energy that causes the ignition being spread over said surface of said primary propellant at the rate at which electric current spreads through said polymer over said surface of said primary propellant.

2. The propellant system of claim 1 wherein said surface includes a side surface and end surfaces, said polymer is coated on said side surface and said end surfaces.

3. The propellant system of claim 1 wherein said means to supply current supplies a predetermined voltage to cause said polymer to produce an electric arc.

4. The propellant system of claim 1 wherein said polymer is an organic polymer.

5. The propellant system of claim 4 wherein said polymer is selected from the group comprising polyaniline, leucopolyaniline and pernigraniline.

6. The propellant system of claim 5 wherein said polymer is polyaniline.

7. The propellant system of claim 1 wherein said primary propellant has a hollow portion therethrough and end surfaces, said polymer being coated to an inside surface of said hollow portion and said end surfaces, wherein said primary propellant forms a self-pressurizing system.

8. The propellant system of claim 1 wherein said polymer is coated on an inside surface of a hollow portion of said primary propellant.

9. A method for igniting a primary propellant comprising the steps of:

applying a chemically insensitive conductive polymer to a surface of said primary propellant; and supplying current to said polymer, wherein said current heats said polymer to a temperature for igniting said primary propellant, the energy for ignition of said primary propellant being applied to said polymer at the rate at which electric current spreads through said polymer over said surface of said primary propellant.

10. The method of claim 9 wherein said surface includes a side surface and end surfaces of said primary propellant and polymer is applied to said side surface and said end surfaces of said primary propellant.

11. The method of claim 10 wherein said polymer is applied by coating said polymer on said primary propellant.

12. The method of 9 wherein said polymer is an organic polymer.

* * * * *